US007396992B2

(12) United States Patent
Tamura et al.

(10) Patent No.: US 7,396,992 B2
(45) Date of Patent: Jul. 8, 2008

(54) TONE SYNTHESIS APPARATUS AND METHOD

(75) Inventors: Motoichi Tamura, Hamamatsu (JP); Yasuyuki Umeyama, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 17 days.

(21) Appl. No.: 11/441,682

(22) Filed: May 26, 2006

(65) Prior Publication Data

US 2006/0272482 A1 Dec. 7, 2006

(30) Foreign Application Priority Data

May 30, 2005 (JP) ..... 2005-156560

(51) Int. Cl.
*G10H 1/08* (2006.01)
*G10H 7/00* (2006.01)

(52) U.S. Cl. ..... 84/625; 84/627

(58) Field of Classification Search ..... 704/258, 704/E13.009; 84/604, 609, 625, 627; 381/61
See application file for complete search history.

(56) References Cited

U.S. PATENT DOCUMENTS 5,371,315 A 12/1994 Hanzawa et al.
5,687,240 A * 11/1997 Yoshida et al. ..... 381/61
6,150,598 A 11/2000 Suzuki et al.
6,255,576 B1 7/2001 Suzuki et al.
2002/0178006 A1 11/2002 Suzuki et al.
2004/0055449 A1 3/2004 Akazawa et al.

FOREIGN PATENT DOCUMENTS

EP 0 907 160 A 4/1999
EP 1 087 369 A 3/2001

* cited by examiner

*Primary Examiner*—Lincoln Donovan
*Assistant Examiner*—Andrew R Millikin
(74) *Attorney, Agent, or Firm*—Morrison & Foerster LLP

(57) ABSTRACT

Determination is made, in accordance with acquired performance information, as to whether a crossfade characteristic should be changed or not, and a crossfade characteristic of crossfade synthesis having already been started at the time of the acquisition of the performance information was acquired are automatically changed in accordance with a result of the determination. Because the crossfade characteristic is automatically changed during the course of the crossfade synthesis, the time length of the crossfade synthesis can be expanded or contracted as compared to the time length that had been preciously set at the beginning of the crossfade synthesis, and thus, the time position of a succeeding one of rendition style modules to be time-serially combined in accordance with the acquired performance information can be allotted to a time position displaced by an amount corresponding to the expanded or contracted time.

5 Claims, 5 Drawing Sheets

TONE SYNTHESIS APPARATUS AND METHOD

BACKGROUND OF THE INVENTION

The present invention relates to tone synthesis apparatus, methods and programs for generating waveforms of tones, voices or other desired sounds, for example, on the basis of readout of waveform data from a memory or the like while varying a timbre and rendition style (or articulation) of the tones, voices or other sounds. More particularly, the present invention relates to an improved tone synthesis apparatus, method and program which perform control to reduce a delay in tone generation (i.e., tone generation delay) etc. that may occur during, for example, a real-time performance.

In recent years, there has been known a tone waveform control technique called "SAEM" (Sound Articulation Element Modeling), which is intended for realistic reproduction and control of various rendition styles (various types of articulation) peculiar to natural musical instruments. Among examples of equipment using the SAEM technique is an apparatus disclosed in Japanese Patent Application Laid-open Publication No. HEI-11-167382 (hereinafter referred to as "patent literature 1"). The conventionally-known apparatus equipped with a tone generator using the SAEM technique, such as the one disclosed in patent literature 1, are arranged to generate a continuous tone waveform by time-serially combining a plurality of ones of rendition style modules prepared in advance for individual portions of tones, such as an attack-related rendition style module defining an attack waveform, release-related rendition style module defining a release waveform, body-related rendition style module defining a body waveform (intermediate waveform) constituting a steady portion of a tone and a joint waveform interconnecting tones. For example, the apparatus can generate a waveform of an entire tone by crossfade-synthesizing waveforms of individual portions of the tone using an attack-related rendition module for an attack portion, i.e. a rise portion, of the tone, one or more body-related rendition modules for a body portion, i.e. a steady portion, of the tone and a release-related rendition style module for a release portion, i.e. a fall portion, of the tone. Also, by using a joint-related rendition style module in place of the release-related rendition style module, the apparatus can also generate a series of waveforms of a plurality of successive tones (or tone portions) connected together by a desired rendition style. Note that, in this specification, the terms "tone waveform" are used to mean a waveform of a voice or any desired sound rather than being limited only to a waveform of a musical tone.

Further, there have been known apparatus which allow a human player to selectively designate in real time rendition styles to be used, among which is the one disclosed in Japanese Patent Application Laid-open Publication No. 2004-78095 (hereinafter referred to as "patent literature 2").

In apparatus equipped with a tone generator capable of sequentially varying the tone color and rendition style (or articulation) while sequentially crossfade-synthesizing a plurality of waveforms on the basis of a tone synthesis technique as represented by the SAEM synthesis technique, such as those disclosed in patent literature 1 and patent literature 2 mentioned above, at least two tone generating channels are used for synthesis of a tone to additively synthesize waveforms allocated to the tone generating channels while frequently fading out and fading in output tone volumes of the individual tone generating channels, to thereby output a waveform of the entire tone. Example of such tone synthesis is outlined in FIG. 9. More specifically, FIG. 9 is a conceptual diagram showing a general picture of the conventionally-known tone synthesis where synthesis of a tone is performed using two, i.e. first and second, tone generating channels. In FIG. 9, the horizontal axis represents the time, while the vertical axis the respective output volumes of the first and second tone generating channels. Further, to facilitate understanding, the respective output volumes of the two tone generating channels are shown in FIG. 9 as linearly controlled from 0% to 100% within each crossfading time period. Further, in FIG. 9, time point t2, t3, t5 and t6 each represents a point when switching between rendition style modules to be used is completed. These rendition style switching time points t2, t3, t5 and t6, i.e. time positions of the rendition style modules, are determined in advance, in corresponding relation to rendition style modules corresponding to performance operation or operation of rendition-style operators (e.g., rendition style switches) by a human operator, in response to the operation and on the basis of data lengths specific to the rendition style modules designated in accordance with the operation, respective start times of the rendition style modules (which correspond to completion times of individual crossfade syntheses and each of which is variable in accordance with a time vector value or the like varying in accordance with the passage of time), etc.

As seen in FIG. 9, once a note-on event is instructed (more specifically, once note-on even data is received) at time point t0 in response to performance operation by the human player, synthesis of a tone waveform in the form of a non-loop waveform corresponding to an attack portion is started in the first tone generating channel. Following the synthesis of the non-loop waveform corresponding to the attack portion, synthesis of a tone waveform A that is a steady waveform constituting part of the attack waveform and in the form of a loop waveform to be read out repetitively (such a loop waveform is depicted in the figure in a solid-line vertically-elongated rectangle) is started in the first tone generating channel. Then, from the time point (t1), when the synthesis of the tone waveform A has been started, onward, the output volume of the first tone generating channel is gradually decreased from 100% to 0% to thereby fade out the tone waveform A. Simultaneously with the fading-out of the tone waveform A, the output volume of the second tone generating channel is gradually increased from 0% to 100% to thereby fade in a tone waveform B (loop waveform) corresponding to a body portion of the tone. In response to such fade-out/fade-in control, the waveforms of the first and second tone generating channels are additively synthesized into a single loop-reproduced waveform. The thus crossfade-synthesized loop-reproduced waveform smoothly varies from the tone waveform A to the tone waveform B.

Once the output volume of the first tone generating channel reaches 0% and the output volume of the second tone generating channel 100% (time point t2), synthesis of another tone waveform C (loop waveform) constituting the body portion is started in a fading-in manner, and simultaneously fade-out of the tone waveform B in the second tone generating channel is started. Then, once the output volume of the first tone generating channel reaches 100% and the output volume of the second tone generating channel 0% (time point t3), synthesis of still another tone waveform D (loop waveform) constituting the body portion is started in a fading-in manner, and simultaneously fade-out of the tone waveform C in the first tone generating channel is started. In this way, as long as the body portion lasts, the tone is synthesized while fade-in/fade-out is alternately repeated in the first and second tone generating channels with the tone waveform to be used sequentially switched from one to another. Once a note-off event is instructed (more specifically, once note-off even data is received) at time point t4 in response to performance operation by the human player, transition or shift to a non-loop release waveform by way of a steady tone waveform E (loop waveform) constituting part of the release waveform is started after completion of crossfade between the tone waveform C of the first tone generating channel and the tone waveform D of the second tone generating channel (i.e., at time point t5 later by Δt than time point t4 when the note-off instruction was given). In this way, the individual waveforms defined by the above-mentioned rendition style modules connected together can be smoothly connected together by crossfade synthesis between the loop waveforms, so that a continuous tone waveform can be formed as a whole.

In the conventionally-known apparatus equipped with a tone generator using the SAEM technique, as noted above, rendition style modules are allotted in advance to the time axis in response to real-time performance operation, selection instruction operation, etc. by the human player and in accordance with the respective start times of the rendition style modules, and cross-face waveform synthesis is performed between the thus-allotted rendition style modules to thereby generate a continuous tone waveform. Stated differently, the tone synthesis is carried out in accordance with previously-determined crossfade time lengths. However, if the crossfade time lengths are determined in advance, it is not possible to appropriately respond to, or deal with, sudden performance instructions, such as note-off operation during a real-time performance or note-on operation of a tone during generation of another tone. Namely, when a sudden performance instruction has been given, the conventionally-known apparatus shift to a release waveform (or joint waveform) only after crossfade synthesis having already been started at the time point when the performance instruction was given is completed, so that complete deadening of the previous tone would be delayed by an amount corresponding to the waiting time till the completion of the crossfade synthesis and thus start of generation of the next tone would be delayed by that amount.

SUMMARY OF THE INVENTION

In view of the foregoing, it is an object of the present invention to provide a tone synthesis apparatus, method and program which, in generating a continuous tone waveform by crossfade-synthesizing waveforms of various portions of one or more tones, such as attack, body and release or joint portions, can effectively reduce a tone generation delay that may occur when a sudden performance instruction is given.

In order to accomplish the above-mentioned object, the present invention provides an improved tone synthesis apparatus for outputting a continuous tone waveform by time-serially combining rendition style modules, defining rendition-style-related waveform characteristics for individual tone portions, and sequentially crossfade-synthesizing a plurality of waveforms in accordance with the combination of the rendition style modules by use of at least two channels, which comprises: an acquisition section that acquires performance information; a determination section that makes a determination, in accordance with the performance information acquired by the acquisition section, as to whether a crossfade characteristic should be changed or not; and a change section that, in accordance with a result of the determination by the determination section, automatically changes a crossfade characteristic of crossfade synthesis having already been started at a time point when the performance information was acquired by the acquisition section. In the present invention, n a time position of a succeeding one of rendition style modules to be time-serially combined in accordance with the acquired performance information is controlled by the change section automatically changing the crossfade characteristic of the crossfade synthesis having already been started at the time point when the performance information was acquired by the acquisition section.

In outputting a continuous tone waveform by time-serially combining rendition style modules, defining rendition-style-related waveform characteristics for individual tone portions, and sequentially crossfade-synthesizing a plurality of waveforms in accordance with the combination of the rendition style modules by use of at least two channels, the tone synthesis apparatus of the present invention determines, in accordance with performance information acquired by the acquisition section, as to whether a crossfade characteristic should be changed or not. Then, in accordance with the result of the determination, the crossfade characteristic of crossfade synthesis having already been started when the performance information was acquired is automatically changed. Because the crossfade characteristic is automatically changed during the course of the crossfade synthesis, the time length of the crossfade synthesis can be expanded or contracted as compared to the time length that had been previously set at the beginning of the crossfade synthesis, and thus, the time position of the succeeding one of the rendition style modules to be time-serially combined in accordance with the acquired performance information can be allotted to a time position displaced by an amount corresponding to the expanded or contracted time. In this way, control can be performed automatically, even during the course of the crossfade synthesis, to allow the crossfade synthesis to be completed earlier (or later), so that a waveform shift can be made over to the succeeding rendition style module earlier (or later), without a human player being conscious of the waveform shift.

Namely, the present invention is characterized in that, during the course of crossfade synthesis having already been started when a performance instruction was given, the crossfade characteristic of the crossfade synthesis is automatically changed. With such an arrangement, the time length of the crossfade synthesis can be expanded or contracted as compared to the time length that had been previously set at the beginning of the crossfade synthesis, so that a waveform shift can be effected earlier (or later), without a human player being conscious of the waveform shift.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
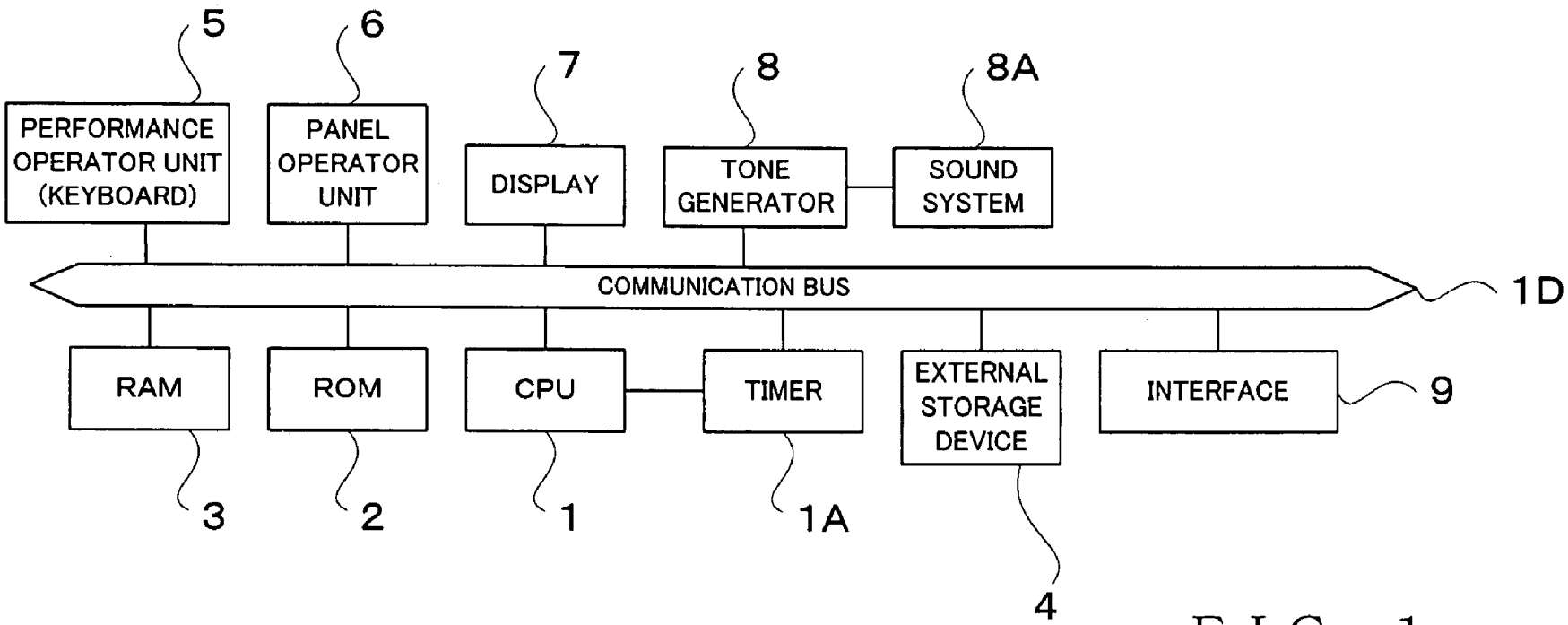
FIG. 1 is a block diagram showing an exemplary general hardware setup of an electronic musical instrument to which is applied a tone synthesis apparatus in accordance with an embodiment of the present invention.

FIG. 1 is a block diagram showing an exemplary general hardware setup of an electronic musical instrument to which is applied a tone synthesis apparatus in accordance with an embodiment of the present invention. The electronic musical instrument illustrated here is implemented using a computer, where tone synthesis processing, as typified by the SAEM synthesis technique or method, for sequentially crossfade-synthesizing a plurality of waveforms to output a continuous tone waveform while varying the tone color and rendition style (or articulation) is carried out by the computer executing a predetermined program (software) for realizing the tone synthesis processing of the present invention. Needless to say, the tone synthesis processing may be implemented by microprograms to be executed by a DSP (Digital Signal Processor), rather than by such computer software. Also, the tone synthesis processing may be implemented by a dedicated hardware apparatus having discrete circuits or integrated or large-scale integrated circuit incorporated therein. Further, the equipment to which is applied the tone synthesis apparatus of the present invention may be embodied as an electronic musical instrument, automatic performance apparatus, such as a sequencer, karaoke apparatus, electronic game apparatus, multimedia-related apparatus, personal computer or any other desired form of product. Namely, the tone synthesis apparatus of the present invention may be constructed in any desired manner as long as it can generate tones, imparted with user-desired tone colors and rendition styles (or articulation), in accordance with normal performance information, such as note-on and note-off event information generated in response to operation of, for example, a performance operator unit 5, such as a keyboard, operators of a panel operator unit 6, switch output information, etc. Note that, although the electronic musical instrument employing the tone synthesis apparatus to be described below may include other hardware than the above-mentioned, it will hereinafter be described in relation to a case where only necessary minimum resources are used.

In the electronic musical instrument of FIG. 1, various processes are carried out under control of a microcomputer including a microprocessor unit (CPU) 1, a read-only memory (ROM) 2 and a random access memory (RAM) 3. The CPU 1 controls operation of the entire electronic musical instrument. To the CPU 1 are connected, via a communication bus (e.g., data and address bus) 1D, the ROM 2, RAM 3, external storage device 4, performance operator unit 5, panel operator unit 6, display device 7, tone generator 8 and interface 9. Also connected to the CPU 1 is a timer 1A for counting various times, for example, to signal interrupt timing for timer interrupt processes. Namely, the timer 1A generates tempo clock pulses for counting a time interval or setting a performance tempo with which to perform a music piece in accordance with given performance information. The frequency of the tempo clock pulses is adjustable, for example, via a tempo-setting switch of the panel operator unit 6. Such tempo clock pulses generated by the timer 1A are given to the CPU 1 as processing timing instructions or as interrupt instructions. The CPU 1 carries out various processes in accordance with such instructions.

The ROM 2 stores therein various programs for execution by the CPU 1 and various data. The RAM 3 is used as a working memory for temporarily storing various data generated as the CPU 1 executes predetermined programs, as a memory for storing a currently-executed program and data related to the currently-executed program, and for various other purposes. Predetermined address regions of the RAM 3 are allocated to various functions and used as various registers, flags, tables, memories, etc. The external storage device 4 is provided for storing various data, such as rendition style modules for generating tones corresponding to rendition styles specific to various musical instruments, and various control programs to be executed or referred to by the CPU 1. In a case where a particular control program is not prestored in the ROM 2, the control program may be prestored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may use any of various removable-type recording media other than the hard disk (HD), such as a flexible disk (FD), compact disk (CD-ROM or CD-RAM), magneto-optical disk (MO) and digital versatile disk (DVD); alternatively, the external storage device 4 may comprise a semiconductor memory. It should be appreciated that other data than the above-mentioned may be stored in the ROM 2, external storage device 4 and RAM 3.

The performance operator unit 5 is, for example, a keyboard including a plurality of keys operable to select pitches of tones to be generated and key switches corresponding to the keys. The performance operator unit 5 generates performance information for a tone performance; for example, the performance operator unit 5 generates, in response to ON/OFF operation by the user or human player, performance information (e.g., MIDI information), including event data, such as note-on and note-off event data, various control data, such as control change data, etc. It should be obvious that the performance operator unit 5 may be of any desired type other than the keyboard type, such as a neck-like device type having tone-pitch selecting strings provided thereon. The operator unit 6 includes various operators, such as setting switches operable to set tone pitches, colors, effects, etc. with which tones are to be performed, and rendition style switches operable by the human player to designate types (or contents) of rendition styles to be imparted to individual portions of tones. The panel operator unit 6 also include various other operators, such as a numeric keypad, character (text)-data entering keyboard and mouse. Note that the keyboard 5 may be used as input means, such as setting switches and rendition switches. The display device 7, which comprises a liquid crystal display (LCD), CRT (Cathode Ray Tube) and/or the like, visually displays a listing of prestored rendition style modules, contents of the individual rendition style modules, controlling states of the CPU 1, etc.

The tone generator 8, which is capable of simultaneously generating tone signals in a plurality of tone generation channels, receives performance information supplied via the communication bus 1D and generates tone signals by performing tone synthesis on the basis of the received performance information. Namely, as a rendition style module corresponding to the performance information is read out from the ROM 2 or external storage device 4, waveform data defined by the read-out rendition style module are delivered via the communication bus 1D to the tone generator 8 and stored in a buffer of the tone generator 8 as necessary. Then, the tone generator 8 outputs the buffered waveform data at a predetermined output sampling frequency. Tone signals generated by the tone generator 8 are subjected to predetermined digital processing performed by a not-shown effect circuit (e.g., DSP (Digital Signal Processor)) or the like, and the tone signals having been subjected to the digital processing are supplied to a sound system 8A, including an amplifier, speaker, etc., for audible reproduction or sounding.

The interface 9, which is, for example, a MIDI interface, communication interface, etc., is provided for communicating various MIDI information between the electronic musical instrument and external or other MIDI equipment (not shown). The MIDI interface functions to input performance information based on the MIDI standard (i.e., MIDI information) from the external MIDI equipment or the like to the electronic musical instrument, or output MIDI information from the electronic musical instrument to other MIDI equipment or the like. The other MIDI equipment may be of any type (or operating type), such as a keyboard type, guitar type, wind instrument type, percussion instrument type or gesture type, as long as it can generate MIDI information in response to operation by a user of the equipment. The MIDI interface may be a general-purpose interface rather than a dedicated MIDI interface, such as RS232-C, USB (Universal Serial Bus) or IEEE1394, in which case other data than MIDI data may be communicated at the same time. The communication interface, on the other hand, is connected to a wired or wireless communication network (not shown), such as a LAN, Internet, telephone line network, via which the communication interface is connected to an external server computer or the like. Thus, the communication interface functions to input various information, such as a control program and various information, such as MIDI information, from the server computer to the electronic musical instrument. Such a communication interface may be capable of both wired and wireless communication rather than just one of wired and wireless communication.

Figure 2:
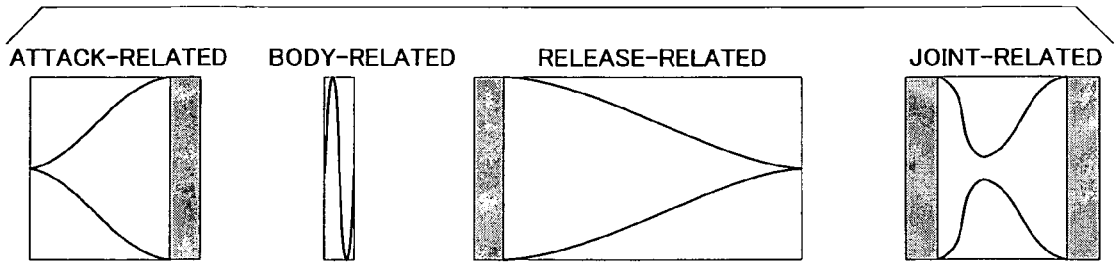
FIG. 2 is a conceptual diagram explanatory of rendition style modules to be imparted to various portions of tones.

Now, with reference to FIG. 2, an outline will be given about conventionally-known rendition style modules prestored in the ROM 2, external storage device 4 or RAM 3 and used for generating tones corresponding to tones colors and rendition styles (or articulation) specific to various musical instruments. FIG. 2 is a conceptual diagram showing examples of conventionally-known rendition style modules to be imparted to various portions of tones.

As conventionally known, the rendition style modules are prestored, in the ROM 2, external storage device 4, RAM 3 or the like, as a "rendition style table" where a variety of rendition style modules are compiled as a database. The rendition style modules each comprises original waveform data to be used for reproducing a waveform corresponding to any one of variety of rendition styles, and a group of related data. Each of the "rendition style modules" is a rendition style waveform unit that can be processed as a single data block in a rendition style waveform synthesis system; in other words, each of the "rendition style modules" is a rendition style waveform unit that can be processed as a single event. Broadly classified, the rendition style modules, as seen from FIG. 2, include, in correspondence with timewise sections or portions etc. of performance tones, attack-related, body-related, release-related rendition style modules, etc. defining waveform data of individual portions, such as attack, body and release portions, of tones, as well as joint-related rendition style modules, such as a slur rendition style, defining waveform data of joint portions of successive tones.

Such rendition style modules can be classified more finely into several rendition style types on the basis of characters of the individual rendition styles, in addition to the above-mentioned classification based on various portions of performance tones. For example, the rendition style modules may be classified into: "Bendup Attack" which is an attack-related rendition style module that causes a bendup to take place immediately after a rise of a tone; "Glissup Attack" which is an attack-related rendition style module that causes a glissup to take place immediately after a rise of a tone; "Vibrato Body" which is a body-related rendition style module representative of a vibrato-imparted portion of a tone between rise and fall portions of a tone; "Benddown Release" which is a release-related rendition style module that causes a benddown to take place immediately before a fall of a tone; "Glissdown Release" which is a release-related rendition style module that causes a benddown to take place immediately after a fall of a tone; "Gliss Joint" which is a joint-related rendition style module that interconnects two tones while effecting a glissup or glissdown; "Bend Joint" which is a joint-related rendition style module that interconnects two tones while effecting a bendup or benddown. The human player can select any desired one of such rendition style types by operating any of the above-mentioned rendition style switches; however, these rendition style types will not be described in this specification because they are already known in the art. Needless to say, the rendition style modules are classified per original tone generator, such as musical instrument type. Further, selection from among various rendition style types may be made by any other means than the rendition style switch.

In the instant embodiment of the present invention, each set of waveform data corresponding to one rendition style module is stored in a database as a data set of a plurality of waveform-constituting factors or elements, rather than being stored directly as the waveform data; each of the waveform-constituting elements will hereinafter be called a "vector". As an example, vectors corresponding to one rendition style module may include the following. Note that "harmonic" and "nonharmonic" components are defined here by separating an original rendition style waveform into a sine wave, waveform having a harmonious component capable of being additively synthesized, and the remaining waveform component 1) Waveform shape (Timbre) vector of the harmonic component: This vector represents only a characteristic of a waveform shape extracted from among the various waveform-constituting elements of the harmonic component and normalized in pitch and amplitude.

2) Amplitude vector of the harmonic component: This vector represents a characteristic of an amplitude envelope extracted from among the waveform-constituting elements of the harmonic component.
3) Pitch vector of the harmonic component: This vector represents a characteristic of a pitch extracted from among the waveform-constituting elements of the harmonic component; for example, it represents a characteristic of timewise pitch fluctuation relative to a given reference pitch.
4) Waveform shape (Timbre) vector of the nonharmonic component: This vector represents only a characteristic of a waveform shape (noise-like waveform shape) extracted from among the waveform-constituting elements of the nonharmonic component and normalized in amplitude.
5) Amplitude vector of the nonharmonic component: This vector represents a characteristic of an amplitude envelope extracted from among the waveform-constituting elements of the nonharmonic component.

The rendition style waveform data of the rendition style module may include one or more other types of vectors, such as a time vector indicative of a time-axial progression of the waveform, although not specifically described here.

For synthesis of a tone, waveforms or envelopes corresponding to various constituent elements of a rendition style waveform are constructed along a reproduction time axis of a performance tone by applying appropriate processing to these vector data to thereby modify the data values and arranging or allotting the thus-processed vector data on or to the time axis and then carrying out predetermined waveform synthesis processing on the basis of the vector data allotted to the time axis. For example, in order to produce a desired performance tone waveform, i.e. a desired rendition style waveform, exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and with an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic component's waveform segment and nonharmonic component's waveform segment, so that the tone to be sounded ultimately can be generated. Such tone synthesis processing will not be described later because it is known in the art.

Each of the rendition style modules includes not only the aforementioned rendition style waveform data but also rendition style parameters. The rendition style parameters are parameters for controlling the time, level etc. of the waveform of the rendition style module in question. The rendition style parameters may include one or more kinds of parameters depending on the nature of the rendition style module. For example, the "Bendup Attack" rendition style module may include different kinds of rendition style parameters, such as an absolute tone pitch at the end of the bendup attack, initial bend depth value during the bendup attack, time length from the start to end of the bendup attack, tone volume immediately after the bendup attack and timewise expansion/contraction of a default curve during the bendup attack. These "rendition style parameters" may be prestored in memory, or may be entered by user's input operation. The existing rendition style parameters may be modified via user operation. Further, in a case where no rendition style parameter is given at the time of reproduction of a rendition style waveform, predetermined standard rendition style parameters may be automatically applied. Furthermore, suitable parameters may be automatically produced and applied during the course of processing.

The preceding paragraphs have set forth the case where each rendition style module has all of the waveform-constituting elements (waveform shape, pitch and amplitude) of the harmonic component and all of the waveform-constituting elements (waveform shape and amplitude) of the nonharmonic component, with a view to facilitating understanding of the description. However, the present invention is not so limited, and there may also be used rendition style modules each having only one of the waveform shape, pitch and amplitude elements of the harmonic component and only one of the waveform shape and/or amplitude elements of the nonharmonic component. For example, some rendition style module may have only one of the waveform shape (Timbre), pitch and amplitude elements of the harmonic component and waveform shape and amplitude elements of the nonharmonic component. Such an alternative is preferable in that a plurality of rendition style modules can be used in combination per component.

Figure 3:
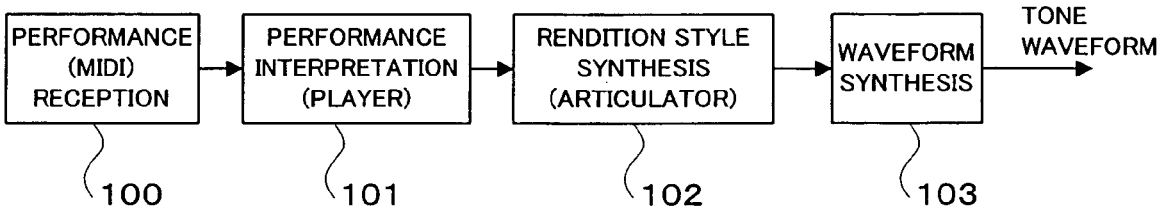
FIG. 3 is a functional block diagram showing a general picture of tone synthesis processing carried out in the electronic musical instrument.

Now, a description will be given about a general picture of the tone synthesis processing carried out in the electronic musical instrument shown in FIG. 1, with reference to FIG. 3. FIG. 3 is a functional block diagram showing an example general picture of the tone synthesis processing, where arrows indicate a processing flow.

Performance reception section 100 performs a performance reception process for receiving in real time performance information (e.g., MIDI information) generated in response to operation by the human player. Namely, MIDI information, such as note-on, note-off and control change data, is output in real time from the performance operator unit 5, such as a keyboard, in response to operation, by the human player, of the performance operator unit 5. Further, rendition style switch output information, indicative of which one of the rendition style switches having rendition style types allocated thereto in advance has been depressed or released, is output in real time, as control change data of MIDI information, from the rendition style switch. The performance reception section 100 is constantly monitoring so as to receive in real time such MIDI information output in response to operation of the performance operator unit 5 or rendition style switch. When MIDI information has been received, the performance reception section 100 outputs the received MIDI information to a performance interpretation section 101.

The performance interpretation section ("player") 101 performs performance interpretation processing on the basis of the received MIDI information. In the performance interpretation processing, the received MIDI information is analyzed to generate rendition style designation information (i.e., rendition style ID and rendition style parameters), and performance information imparted with the thus-generated rendition style designation information (i.e., rendition-style-imparted performance information) is output to a rendition style synthesis section 102. More specifically, portion-specific rendition style modules are determined which are to be imparted at necessary performance time points corresponding to rendition styles in a time-serial flow of the received MIDI information. The performance interpretation processing to be performed by the performance interpretation section 101 is shown in FIG. 4. FIG. 4 is a flow chart showing an example operational sequence of the performance interpretation processing; more specifically, FIG. 4A shows an example operational sequence of the performance interpretation processing performed in response to reception of note-on event data, while FIG. 4B shows an example operational sequence of the performance interpretation processing performed in response to reception of note-off event data.

Figure 4A:
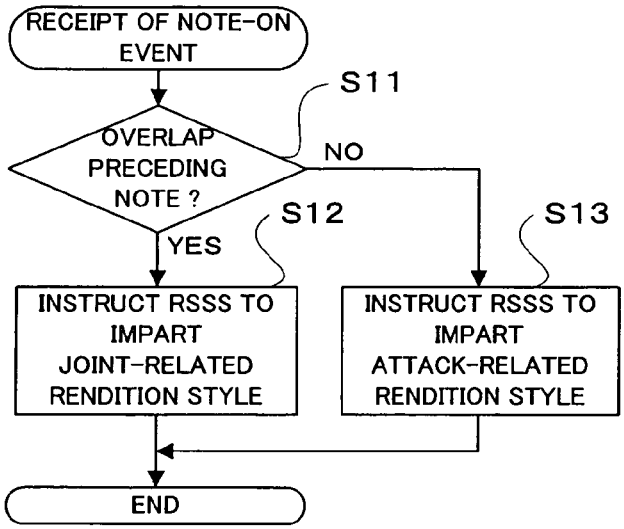
FIG. 4A is a flow chart showing an operational sequence of performance interpretation processing carried out in response to receipt of note-on event data.

Referring first to FIG. 4A, when the performance interpretation section 101 has received note-on event data, a determination is made at step S11 as to whether a note to be sounded in accordance with the received note-on event data overlaps a preceding note being currently sounded (i.e., having already been sounded). More specifically, the determination at step S11 is made by checking whether the time when the note-on event data has been received (i.e., the reception time of the note-on event data) is before or after reception of note-off event data of the preceding note. If the note to be sounded in accordance with the received note-on event data overlaps the preceding note, i.e. if the note-on event data has newly been received before receipt of the note-off event data of the preceding note (YES determination at step S11), the performance interpretation section 101 instructs the rendition style synthesis section 102 to impart a joint-related rendition style, at step S12. If, on the other hand, the note to be sounded in accordance with the received note-on event data does not overlap the preceding note, i.e. if the note-on event data has newly been received after receipt of the note-off event data of the preceding note (NO determination at step S11), the performance interpretation section 101 instructs the rendition style synthesis section 102 to impart an attack-related rendition style, at step S13. Namely, when note-on event data has been received, the performance interpretation section 101 outputs to the rendition style synthesis section 102 rendition-style-imparted performance information with rendition style designation information designating a joint-related rendition style if the note to be sounded in accordance with the received note-on event data overlaps the preceding note, but it outputs to the rendition style synthesis section 102 rendition-style-imparted performance information with rendition style designation information designating an attack-related rendition style if the note to be sounded in accordance with the received note-on event data does not overlap the preceding note.

Figure 4B:
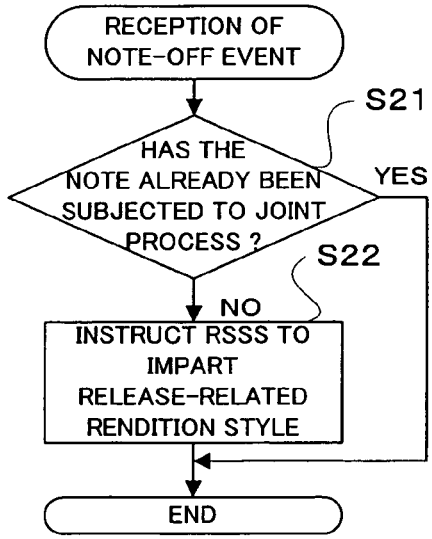
FIG. 4B is a flow chart showing an operational sequence of the performance interpretation processing carried out in response to receipt of note-off event data.

Referring now to FIG. 4B, when the performance interpretation section 101 has received note-off event data, a determination is made at step S21 as to whether a note to be controlled in accordance with the received note-off event data corresponds to a note having already been subjected to a joint process (i.e., already-joint-processed note). If the note to be controlled in accordance with the received note-off event data does not correspond to such an already-joint-processed note (NO determination at step S21), the performance interpretation section 101 instructs the rendition style synthesis section 102 to impart a release-related rendition style, at step S22. Namely, when note-off event data has been received, the performance interpretation section 101 ignores the received note-off event data and does not output rendition-style-imparted performance information to the rendition style synthesis section 102 if next note-on event data has already been received and an instruction has been given for imparting a joint-related rendition style, but, if no instruction has been given for imparting a joint-related rendition style, the performance interpretation section 101 outputs to the rendition style synthesis section 102 rendition-style-imparted performance information imparted with rendition style designation information designating a release-related rendition style.

In the above-described performance interpretation processing, the type of each rendition style which the rendition style synthesis section 102 is instructed to impart is determined in accordance with control change data, included in the MIDI information, output in response to operation of the corresponding rendition style switch. If no such control change data is included, a rendition style of a predetermined default type may be imparted.

Figure 5:
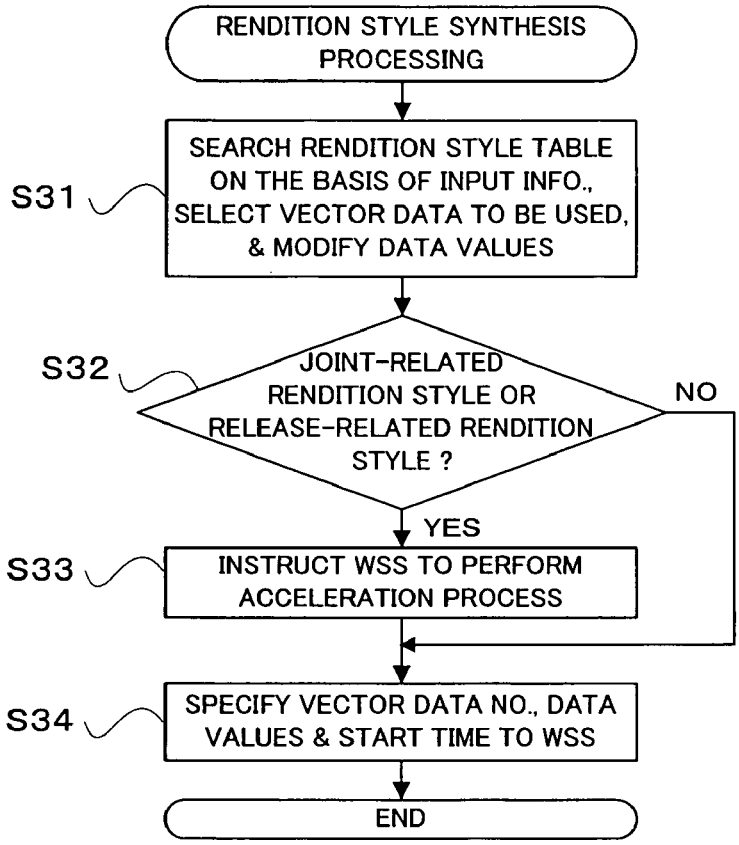
FIG. 5 is a flow chart showing an example operational sequence of rendition style synthesis processing.

Referring back to FIG. 3, the rendition style synthesis section (articulator) 102 performs rendition style synthesis processing. In this rendition style synthesis processing, the rendition style synthesis section 102 refers to the rendition style table, prestored in the external storage device 4, on the basis of the rendition style designation information (i.e., rendition style ID and rendition style parameters) in the rendition-style-imparted performance information generated by the performance interpretation section 101, to generate a packet stream (which may also be referred to as "vector stream") corresponding the rendition style designation information and vector parameters pertaining to the stream. The thus generated packet stream and vector parameters are supplied to the waveform synthesis section 103. Data supplied to the waveform synthesis section 103 as the packet stream include, as regards the pitch element and amplitude element, time information of the packet, vector ID (also called vector data number), a train of values at representative points, etc., and the data supplied to the waveform synthesis section 103 also include, as regards the waveform shape (Timbre) element, vector ID (vector data number), time information, etc. In generating a packet stream, start times at individual positions are calculated in accordance with the time information. Namely, individual rendition style modules are allotted to absolute time positions on the basis of the time information. More specifically, corresponding absolute times are calculated on the basis of element data indicating relative time positions, In this way, start times of the individual rendition style modules are calculated. FIG. 5 is a flow chart showing an example operational sequence of the rendition style synthesis processing performed by the rendition style synthesis section 102.

At step S31, the rendition style table is searched on the basis of the input information, i.e. rendition-style-imparted performance information, to select vector data to be used, and data values of the selected vector data are modified on the basis of the rendition-style-imparted performance information. For example, At this step, there performed operations, such as selection of vector data to be used, instruction related to qualification of vector data as to how the pitch element and amplitude element are to be controlled, start time calculation as to at what times vector data are to be used. At next step S32, a determination is made as to whether or not an instruction has been given for imparting a joint-related rendition style or release-related rendition style. If an instruction has been given for imparting a joint-related rendition style or release-related rendition style (i.e., YES determination at step S32), the rendition style synthesis section 102 instructs the waveform synthesis section 103 to perform a later-described acceleration process of FIG. 6, at step S33. At next step S34, the rendition style synthesis section 102 specifies, to the waveform synthesis section 103, the vector ID (vector data number), data values and start time. The start time thus specified to the waveform synthesis section 103 is the start time determined at step S31 above, or crossfade completion time advanced from the initially-set time and calculated by the acceleration process of step S33 above (see FIG. 6). In the case where the crossfade completion time advanced from the initial time is specified as the start time, the rendition style synthesis section 102 instructs the waveform synthesis section 103 to perform accelerated crossfade synthesis.

Figure 6:
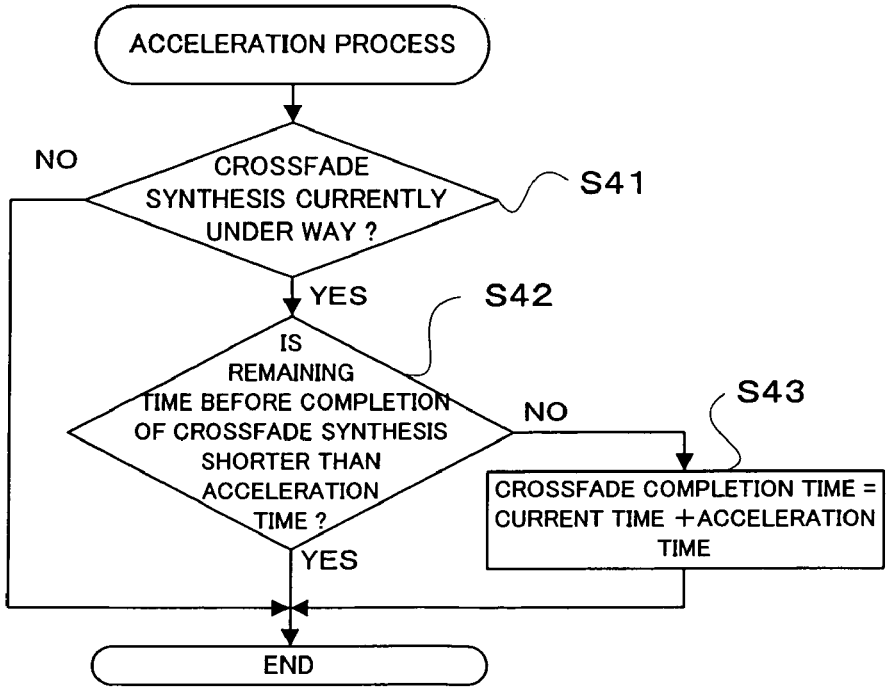
FIG. 6 is a flow chart showing an example operational sequence of an acceleration process.

Referring back to FIG. 3, the waveform synthesis section 103 performs waveform synthesis processing, where vector data are read out or retrieved from the "rendition style table" in accordance with the packet stream, the read-out vector data are modified in accordance with the vector parameters and then a waveform is synthesized on the basis of the modified vector data. At that time, the crossfade synthesis completion time is advanced from the initial time in accordance with the instruction given from the rendition style synthesis section 102 (see step S33 of FIG. 5), so that the waveform synthesis section 103 performs the accelerated crossfade synthesis to promptly complete the currently-performed crossfade synthesis. FIG. 6 is a flow chart showing an example operational sequence of the acceleration process for advancing the crossfade synthesis completion time from the initial time (see step S33 of FIG. 5).

At step S41, a determination is made as to whether the crossfade synthesis is currently under way. If the crossfade synthesis is currently under way (YES determination at step S41), the acceleration process goes to step S42, where it is further determined, on the basis of the start time previously specified by the rendition style synthesis section 102 (see step S31 of FIG. 5), whether or not the remaining time before completion of the current crossfade synthesis is shorter than a predetermined acceleration time (e.g., 10 ms). If the remaining time before the completion of the crossfade synthesis is not shorter than the predetermined acceleration time (NO determination at step S42), a crossfade completion time is newly calculated and set, at step S43. As an example, a sum of "current time+acceleration time" is set as the new crossfade completion time.

Figure 7:
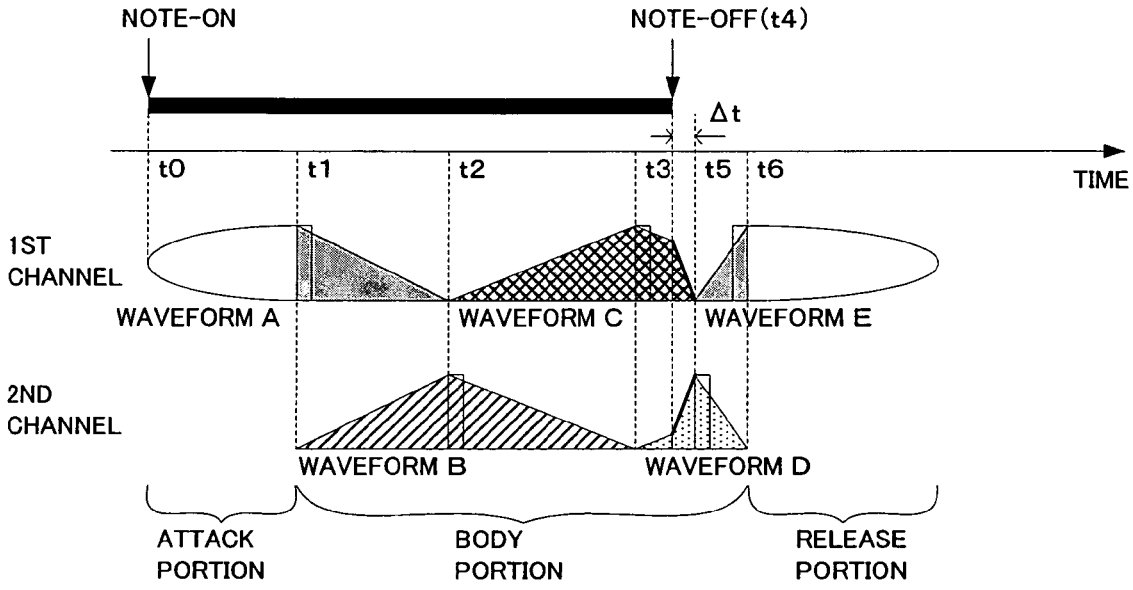
FIG. 7 is a conceptual diagram outlining how tone synthesis is carried out by applying accelerated crossfade synthesis to a release portion of a tone.
Figure 8:
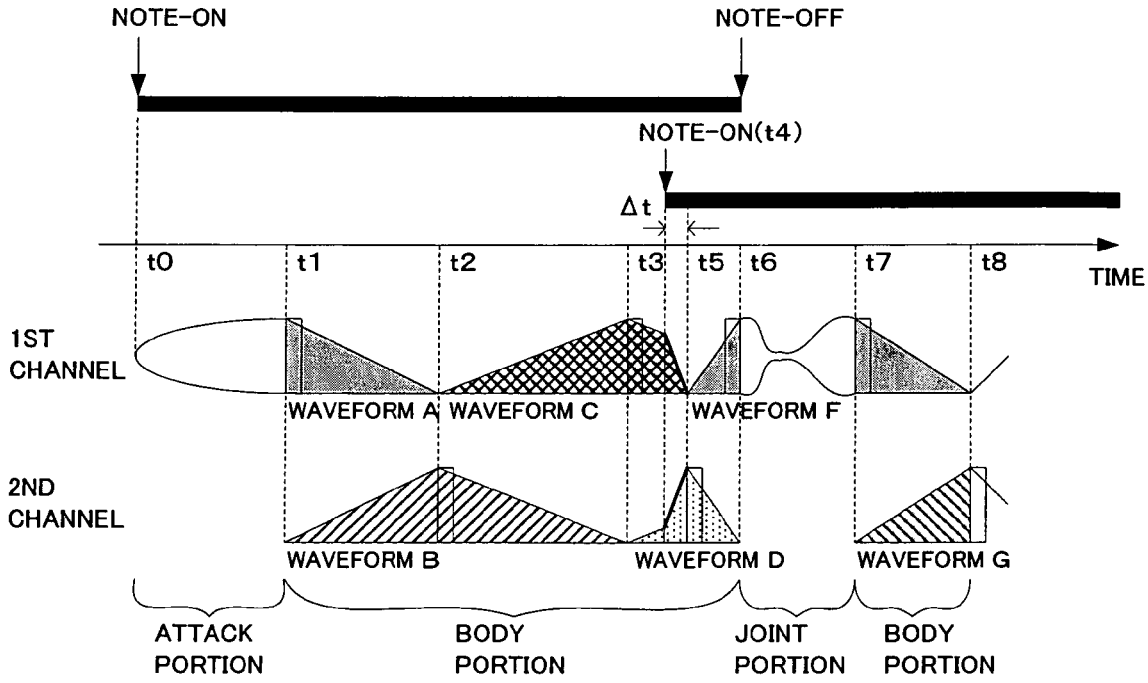
FIG. 8 is a conceptual diagram outlining how tone synthesis is carried out by applying the accelerated crossfade synthesis to a joint portion of a tone.
Figure 9:
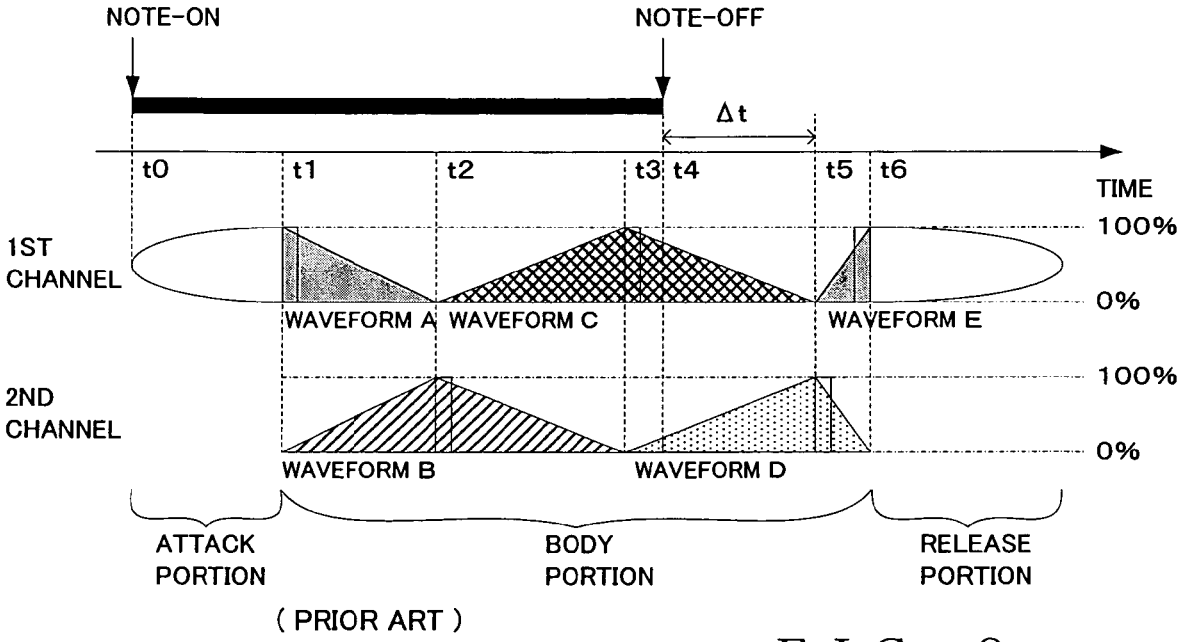
( PRIOR ART ) F I G. 9
FIG. 9 is a conceptual diagram outlining conventionally-known tone synthesis.

Next, a description will be given, using a specific example, about the accelerated crossfade synthesis intended to promptly complete the currently-performed crossfade synthesis by the new crossfade completion time having been calculated in the aforementioned acceleration process. FIG. 7 is a conceptual diagram outlining how tone synthesis is carried out by applying the accelerated crossfade synthesis to a release portion of a tone. FIG. 8 is a conceptual diagram outlining how tone synthesis is carried out by applying the accelerated crossfade synthesis to a joint portion. The tone synthesis described here uses two, i.e. first and second tone generating channels, similarly to the conventionally-known example explained above in relation to FIG. 9. Tone synthesis operations performed at time point t0 to t3 are similar to those in the conventionally-known example of FIG. 9 and thus will not be described here to avoid unnecessary duplication.

As seen from FIG. 7, at a time point when the output volumes of the first and second tone generating channels have reached 100% and 0%, respectively, (i.e., at time point t3), the synthesis is started while still another tone waveform D (loop waveform) constituting a body portion is being caused to fade in via the second tone generating channel, and simultaneously, fade-out of a tone waveform C of the first tone generating channel is started. Once a note-off instruction is given at time point t4 in response to performance operation by the human player during the crossfade synthesis, the above-described acceleration process (FIG. 6) is carried out to change the crossfade completion time to time t5. Then, in order that the currently-performed crossfade synthesis (i.e., already-started crossfade synthesis) may be completed by the crossfade completion time t5, the accelerated crossfade synthesis for expediting the fade-in and fade-out rates (i.e., crossfade synthesis based on accelerated fade-out and fade-in according to crossfade curves from time point t4 to t5 with inclinations different from inclinations from time point t3 to time point t4, as indicated in thick lines in the figure) is automatically performed so as to allow a waveform transition or shift from the body portion (tone waveform D) to the release portion (tone waveform E) to be effected more promptly than the crossfade synthesis based on the conventional technique. Generally, during a shift between loop waveforms of the body portion (e.g., shift to tone waveform B, tone waveform C or tone waveform D), rapid variation in tone color, rendition style, etc. tends to sound unnatural; thus, a relatively long crossfade time (e.g., 50 ms) may be required. However, during a shift from the body portion to the release portion, involving a connection to a tone-deadening transient tone waveform, the inconvenience that the sound sounds unnatural will not appear apparently even if the crossfade time is made short. Therefore, the currently-performed crossfade synthesis is accelerated so as to be completed by the completion time in such a manner that the shift to a release waveform is started at time point t5, corresponding to a sum of values of the time t4 when the note-off instruction was given and a time Δt representing an acceleration time, without waiting until crossfade synthesis between the tone waveform C being processed at the time of the note-off instruction and the tone waveform D is completed at the previously-set completion time, as in the conventional technique of FIG. 9, Stated differently, the start time of the release waveform is changed by changing a crossfade characteristic during the course of the crossfade synthesis. By thus automatically controlling, during the course of the crossfade synthesis having already been started at the time point when the note-off instruction was given, the crossfade synthesis completion time such that the crossfade synthesis is completed earlier than the previously-set completion time, the waveform shift from the body portion to the release portion can be made more promptly than in the conventional technique without the human player being particularly conscious of the waveform shift; thus, the instant embodiment can reduce a tone generation delay of a next note to be sounded based on a next note-on instruction (not shown).

As seen from FIG. 8, at a time point when the output volumes of the first and second tone generating channels have reached 100% and 0%, respectively, (i.e., at time point t3), the synthesis is started while still another tone waveform D (loop waveform) constituting the body portion is being caused to fade in via the second tone generating channel, and simultaneously, fade-out of the tone waveform C of the first tone generating channel is started. Once a note-on instruction is given at time point t4 in response to performance operation by the human player during such crossfade synthesis, the above-described acceleration process (FIG. 6) is carried out to change the crossfade completion time to time t5. Then, in order that the currently-performed crossfade synthesis may be completed by the crossfade completion time t5, the accelerated crossfade synthesis (i.e., crossfade synthesis according to crossfade curves from time point t4 to t5 with inclinations different from inclinations from time point t3 to time point t4, as indicated in thick lines in the figure) is automatically performed so as to allow a shift from the body portion (tone waveform D) to the joint portion (tone waveform F) to be effected promptly. Namely, the currently-performed crossfade synthesis is accelerated so as to be completed by the above-mentioned completion time in such a manner that the shift to a joint waveform is started at time point t5, corresponding to a sum of values of the time t4 when the note-on instruction was given and the time Δt representing an acceleration time, without waiting until crossfade synthesis between the tone waveform C being processed when the note-on instruction was given and the tone waveform D is completed at the previously-set completion time. Stated differently, the start time of the joint waveform is changed by changing the crossfade characteristic during the course of the crossfade synthesis. By thus automatically controlling, during the course of the crossfade synthesis having already been started when the note-on instruction was given prior to a note-off instruction, the crossfade synthesis completion time so that the crossfade synthesis is completed earlier than the previously-set completion time, the waveform shift from the body portion to the joint portion can be made, more promptly than in the conventional technique, without the human player being particularly conscious of the waveform shift; thus, the instant embodiment can reduce a tone generation delay of a succeeding one of a plurality of notes to be connected together to such an extent that the delay will not be particularly perceived.

Whereas the embodiment has been described above in relation to the case where tone waveforms to be crossfade-synthesized are loop waveform segments, non-loop waveform (also called "block waveform") segments may be crossfade-synthesized.

Further, the crossfade characteristic of the crossfade synthesis is not limited to a linear characteristic and may be a non-linear characteristic. Furthermore, the control curve of the crossfade synthesis (i.e., crossfade curve) may be of any desired inclination. The human player may select a desired crossfade characteristic.

Furthermore, the acceleration (crossfade characteristic) of the crossfade synthesis need not necessarily use, or depend on, an absolute time, such as the above-mentioned crossfade completion time; alternatively, the acceleration may use, or depend on, any of a plurality of predetermined crossfade characteristics (i.e., rate dependency), or a combination of crossfade characteristics predetermined per rendition style module.

Furthermore, if, in the above-described acceleration process, next data has already been automatically prepared for the crossfade synthesis before an instruction regarding the next data is given by the rendition style synthesis section 102, then the already-prepared next data may be canceled. This approach is preferable in that it permits a smooth connection to the next data instructed by the rendition style synthesis section 102.

Furthermore, the acceleration time to be used to advance the crossfade synthesis completion time may be set by the user to any desired time, or a different acceleration time may be preset in accordance with the rendition styles to be crossfade-synthesized. If the crossfade synthesis completion time is set to be later than the preset time by increasing the length of the acceleration time, it is possible to retard a waveform shift by a corresponding time amount.

Furthermore, whereas the embodiment has been described as synthesizing a tone on the basis of MIDI information, such as note-on and note-off event information, given from the performance operator unit 5, the present invention may of course be arranged to synthesize a tone on the basis of, for example, music piece data generated based on a plurality of pieces of MIDI information of a music piece prestored in the external storage device 4 or the like in particular order of a performance. Namely, the rendition style impartment may be controlled by the user appropriately operating the rendition style switches to a music piece performance based on such music piece data, rather than operating the rendition style switches to a performance on the keyboard. Further, only MIDI information based on operation of the rendition style switches may be prestored so that the rendition style impartment is automatically controlled in accordance with the MIDI information, in which case the user is allowed to execute only a keyboard performance.

What is claimed is:

1. A tone synthesis apparatus for outputting a continuous tone waveform by time-serially combining rendition style modules defining rendition-style-related waveform characteristics for individual tone portions and sequentially crossfade-synthesizing a plurality of waveforms in accordance with the combination of the rendition style modules by use of at least two channels, said tone synthesis apparatus comprising:

an acquisition section that acquires performance information including instructions for starting and ending generation of a note;

a determination section that makes a determination, in accordance with the performance information acquired by said acquisition section, as to whether a crossfade characteristic of crossfade synthesis of the plurality of waveforms should be changed or not; and a change section that, in accordance with a result of the determination by said determination section, automatically changes the crossfade characteristic of the crossfade synthesis having already been started at a time point when the performance information was acquired by said acquisition section, so as to cause the crossfade synthesis to be completed earlier, wherein a time position of a succeeding one of rendition style modules to be time-serially combined in accordance with the acquired performance information is controlled by said change section automatically changing the crossfade characteristic of the crossfade synthesis having already been started at the time point when the performance information was acquired by said acquisition section.

2. A tone synthesis apparatus as claimed in claim 1 wherein, when the succeeding one of the rendition style modules to be time-serially combined in accordance with the acquired performance information is a rendition module defining any one of a release portion or joint portion, said determination section determines that the crossfade characteristic should be automatically changed.

3. A tone synthesis apparatus as claimed in claim 1 wherein said change section newly calculates a completion time of the crossfade synthesis having already been started and automatically changes the crossfade characteristic so that the crossfade synthesis is completed by the calculated completion time and so that a speed of fade-in or fade-out in each of the channels is accelerated on the basis of the calculated completion time.

4. A tone synthesis method comprising:

a step of acquiring performance information including instructions for starting and ending generation of a note;

a step of making a determination, in accordance with the performance information acquired by said step of acquiring, as to whether a crossfade characteristic should be changed or not; and a step of, when a continuous tone waveform is to be output by time-serially combining rendition style modules defining rendition-style-related waveform characteristics for individual tone portions and sequentially crossfade-synthesizing a plurality of waveforms in accordance with the combination of the rendition style modules by use of at least two channels, automatically changing the crossfade characteristic of the crossfade synthesis of the plurality of waveforms having already been started at a time point when the performance information was acquired by said step of acquiring, so as to cause the crossfade synthesis to be completed earlier, to thereby control a time position of a succeeding one of rendition style modules to be time-serially combined in accordance with the acquired performance information.

5. A computer-readable medium storing a program containing a group of instructions for causing a computer to perform a tone synthesis procedure, said tone synthesis procedure comprising:

a step of acquiring performance information including instructions for starting and ending the generation of a note;

a step of making a determination, in accordance with the performance information acquired by said step of acquiring, as to whether a crossfade characteristic should be changed or not; and a step of, when a continuous tone waveform is to be output by time-serially combining rendition style modules defining rendition-style-related waveform characteristics for individual tone portions and sequentially crossfade-synthesizing a plurality of waveforms in accordance with the combination of the rendition style modules by use of at least two channels, automatically changing the crossfade characteristic of the crossfade synthesis of the plurality of waveforms having already been started at a time point when the performance information was acquired by said step of acquiring, so as to cause the crossfade synthesis to be competed earlier, to thereby control a time position of a succeeding one of rendition style modules to be time-serially combined in accordance with the acquired performance information.

* * * * *